US010163617B2

(12) United States Patent
Collings

(10) Patent No.: US 10,163,617 B2
(45) Date of Patent: Dec. 25, 2018

(54) MULTIPLEXING OF IONS FOR IMPROVED SENSITIVITY

(71) Applicant: DH Technologies Development Pte. Ltd., Singapore (SG)

(72) Inventor: Bruce Andrew Collings, Bradford (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 15/026,238

(22) PCT Filed: Oct. 7, 2014

(86) PCT No.: PCT/IB2014/002037
§ 371 (c)(1),
(2) Date: Mar. 30, 2016

(87) PCT Pub. No.: WO2015/068001
PCT Pub. Date: May 14, 2015

(65) Prior Publication Data

US 2016/0247671 A1 Aug. 25, 2016

Related U.S. Application Data

(60) Provisional application No. 61/901,090, filed on Nov. 7, 2013.

(51) Int. Cl.
*H01J 49/42* (2006.01)
*H01J 49/00* (2006.01)

(52) U.S. Cl.
CPC ..... *H01J 49/4215* (2013.01); *H01J 49/0031* (2013.01); *H01J 49/428* (2013.01)

(58) Field of Classification Search
USPC ..... 250/283
See application file for complete search history.

(56) References Cited

U.S. PATENT DOCUMENTS 3,321,623 A 5/1967 Wilson et al.
5,696,376 A * 12/1997 Doroshenko ..... H01J 49/424 250/282

(Continued)

OTHER PUBLICATIONS

Song; et. al, "Mass Selection of Ions from Beams Using Waveform Isolation in Radiofrequency Quadrupoles", Anal. Chem. 2009, 81, pp. 1833-1840.*

(Continued)

*Primary Examiner* — Phillip A Johnston
(74) *Attorney, Agent, or Firm* — John R. Kasha; Kelly L. Kasha; Kasha Law LLC

(57) ABSTRACT

Systems and methods are provided for multiplexed precursor ion selection using a filtered noise field (FNF). Two or more different precursor ions are selected using a processor. The processor calculates an FNF waveform. The calculated FNF waveform is applied to a continuous beam of ions using the processor. The processors sends information to a mass spectrometer, which includes an ion source that provides the continuous beam of ions and a first quadrupole that receives the continuous beam of ions, so that the first quadrupole applies the calculated FNF waveform to the continuous beam of ions. The first quadrupole applies the calculated FNF waveform to the continuous beam of ions by applying the calculated FNF waveform between pairs of rods or between pairs of auxiliary electrodes placed between rods.

18 Claims, 17 Drawing Sheets

(56) References Cited

U.S. PATENT DOCUMENTS

| | | | | |
|---|---|---|---|---|
| 7,459,679 | B2 * | 12/2008 | Loboda | G01N 23/00 250/292 |
| 2005/0098719 | A1 | 5/2005 | Thomson | |
| 2006/0192101 | A1 | 8/2006 | Takada et al. | |
| 2009/0194688 | A1 | 8/2009 | Harold et al. | |
| 2010/0084547 | A1 | 4/2010 | Derek et al. | |
| 2010/0237236 | A1 * | 9/2010 | Thomson | H01J 49/0045 250/283 |
| 2012/0049059 | A1 | 3/2012 | Taniguchi | |
| 2012/0292495 | A1 | 11/2012 | Hashimoto et al. | |

OTHER PUBLICATIONS

International Search Report and Written Opinion for PCT/IB2014/002037, dated Jan. 29, 2015.

* cited by examiner

100

(PRIOR ART)

MULTIPLEXING OF IONS FOR IMPROVED SENSITIVITY

CROSS REFERENCE TO RELATED APPLICATION

This application claims the benefit of U.S. Provisional Patent Application Ser. No. 61/901,090, filed Nov. 7, 2013, the content of which is incorporated by reference herein in its entirety.

INTRODUCTION

High throughput quantitative mass spectrometry analysis (MS) is generally performed using multiple reaction monitoring (MRM) on a mass spectrometer employing a mass filtering quadrupole, such as a triple quadrupole mass spectrometer, a hybrid linear ion trap quadrupole mass spectrometer or a quadrupole time-of-flight mass spectrometer instrument. Conventionally, target precursor ions are mass selected and fragmented separately. This serial analysis of multiple precursor ions leads to a tradeoff among the overall duty cycle of the data collection process, the signal-to-noise ratio (S/N) of the quantitative data that is collected, and the number of precursor ions monitored. In other words, increasing the S/N for a precursor ion requires that its duty cycle be increased, which implies that some other precursor has a reduced duty cycle.

For example, in order to achieve a certain S/N of the quantitative data collected, the analysis time of each target precursor ion of N target precursor ions is increased by $\Delta t$. This, in turn, increases the total measurement time by $N \times \Delta t$, leading to an increase in duty cycle for the precursor ion of interest. In other words, if the total measurement time is fixed, then increasing the measurement time for an individual precursor ion means that fewer precursor ions can be monitored. This leads to a reduction in N. The duty cycle increases for some precursor ions, but goes down for others Similarly, in order to collect quantitative data for N target precursor ions across a narrow liquid chromatography (LC) peak, for example, the analysis time of each target precursor ion can be decreased. In other words, in order to increase the number of measurements, N, it is necessary to reduce the analysis time for each precursor ion. This is because the width of the LC peak sets the total measurement time. As a result, the S/N of the quantitative data collected for each target precursor ion is reduced, which is undesirable because higher S/N is preferred.

SUMMARY

A system is disclosed for multiplexed precursor ion selection using a filtered noise field (FNF). The system includes a mass spectrometer and a processor. The mass spectrometer includes an ion source that provides a continuous beam of ions. The mass spectrometer further includes a first quadrupole that receives the continuous beam of ions and is adapted to apply an FNF waveform to the continuous beam of ions.

The processor selects two or more different precursor ions by calculating an FNF waveform. The processor applies the calculated FNF waveform to the continuous beam of ions. The FNF waveform is applied to the continuous beam of ions by sending information to the mass spectrometer so that the first quadrupole applies the calculated FNF waveform to the continuous beam of ions.

A method is disclosed for multiplexed precursor ion selection using an FNF. Two or more different precursor ions are selected using a processor by calculating an FNF waveform. The calculated FNF waveform is applied to a continuous beam of ions using the processor by sending information to a mass spectrometer. The mass spectrometer includes an ion source that provides the continuous beam of ions. The mass spectrometer further includes a first quadrupole that receives the continuous beam of ions, so that the first quadrupole applies the calculated FNF waveform to the continuous beam of ions.

A computer program product is disclosed that includes a non-transitory and tangible computer-readable storage medium whose contents include a program with instructions being executed on a processor so as to perform a method for multiplexed precursor ion selection using an FNF.

The method includes providing a system, wherein the system comprises one or more distinct software modules, and wherein the distinct software modules comprise an analysis module and a control module. The analysis module selects two or more different precursor ions by calculating an FNF waveform. The control module applies the calculated FNF waveform to a continuous beam of ions by sending information to a mass spectrometer. The mass spectrometer includes an ion source that provides the continuous beam of ions. The mass spectrometer further includes a first quadrupole that receives the continuous beam of ions, so that the first quadrupole applies the calculated FNF waveform to the continuous beam of ions.

These and other features of the applicant's teachings are set forth herein.

BRIEF DESCRIPTION OF THE DRAWINGS

The skilled artisan will understand that the drawings, described below, are for illustration purposes only. The drawings are not intended to limit the scope of the present teachings in any way.

Figure 1:
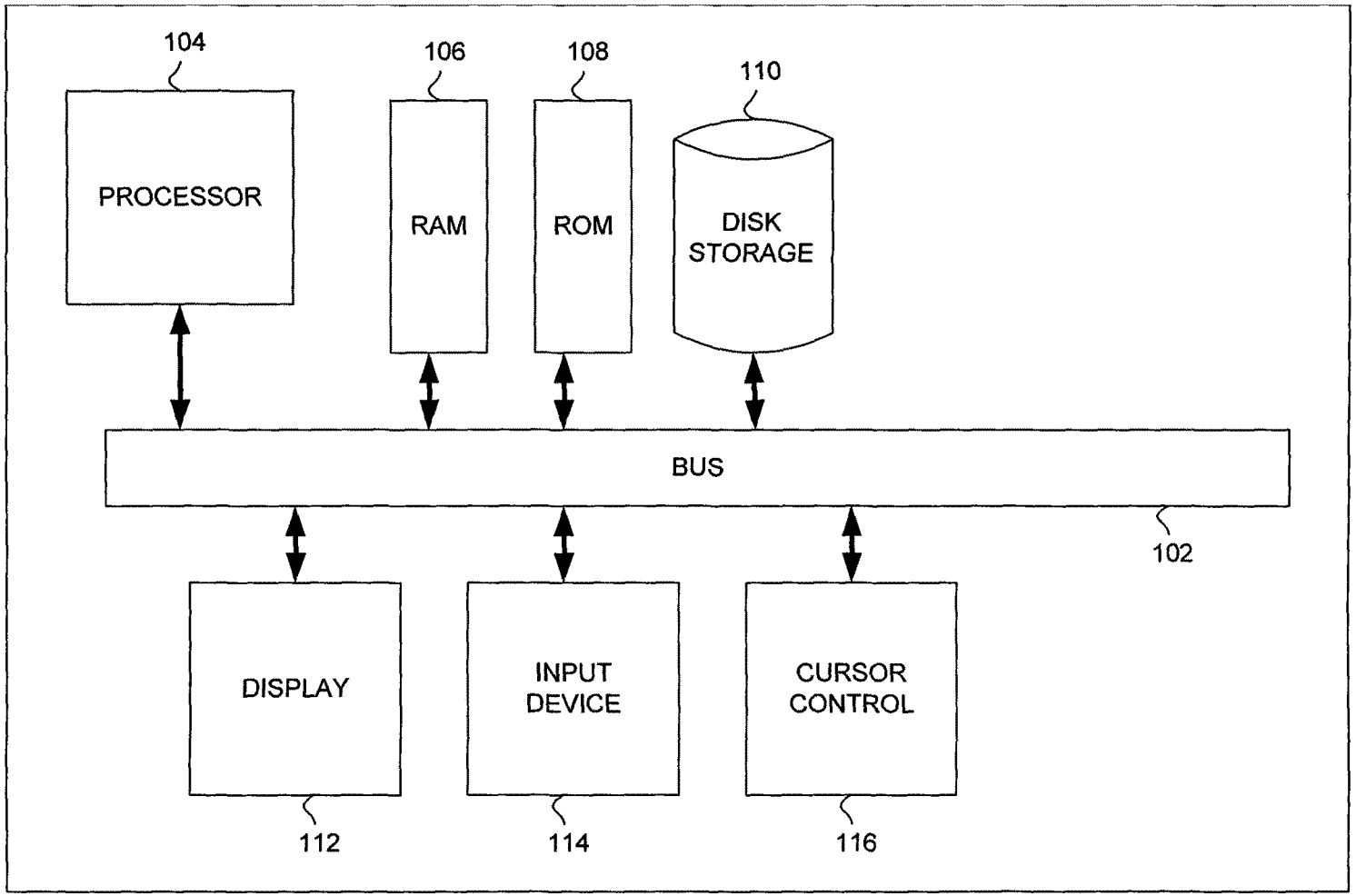
FIG. 1 is a block diagram that illustrates a computer system, upon which embodiments of the present teachings may be implemented.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF VARIOUS EMBODIMENTS

Computer-Implemented System

FIG. 1 is a block diagram that illustrates a computer system 100, upon which embodiments of the present teachings may be implemented. Computer system 100 includes a bus 102 or other communication mechanism for communicating information, and a processor 104 coupled with bus 102 for processing information. Computer system 100 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

A computer system 100 can perform the present teachings. Consistent with certain implementations of the present teachings, results are provided by computer system 100 in response to processor 104 executing one or more sequences of one or more instructions contained in memory 106. Such instructions may be read into memory 106 from another computer-readable medium, such as storage device 110. Execution of the sequences of instructions contained in memory 106 causes processor 104 to perform the process described herein. Alternatively hard-wired circuitry may be used in place of or in combination with software instructions to implement the present teachings. Thus implementations of the present teachings are not limited to any specific combination of hardware circuitry and software.

The term "computer-readable medium" as used herein refers to any media that participates in providing instructions to processor 104 for execution. Such a medium may take many forms, including but not limited to, non-volatile media, volatile media, and transmission media. Non-volatile media includes, for example, optical or magnetic disks, such as storage device 110. Volatile media includes dynamic memory, such as memory 106. Transmission media includes coaxial cables, copper wire, and fiber optics, including the wires that comprise bus 102.

Common forms of computer-readable media include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 100 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software but the present teachings may be implemented as a combination of hardware and software or in hardware alone. The present teachings may be implemented with both object-oriented and non-object-oriented programming systems.

Multiplex Isolation Using a Filtered Noise Field

As described above, conventional serial isolation of multiple target precursor ions in multiple reaction monitoring (MRM) leads to a tradeoff between the overall duty cycle of the data collection process, the signal-to-noise ratio (S/N) of the quantitative data that is collected, and the number of precursor ions monitored. Essentially, improving the overall duty cycle of the data collection process means performing as many precursor ion measurements as possible in a set time period (i.e., the LC peak width). Increasing the number of precursor ions to be measured would result in an increase in the overall duty cycle but a reduction in the duty cycle for each individual precursor ion. In other words, any improvement in the overall duty cycle of the data collection process reduces the S/N of the quantitative data that is collected. Assuming that the only variable available for improving S/N is to increase the measurement time, any improvement in the S/N of the quantitative data adversely affects the overall duty cycle of the data collection process, if the overall measurement time is fixed by for example, the duration of a liquid chromatography (LC) peak.

Figure 2:
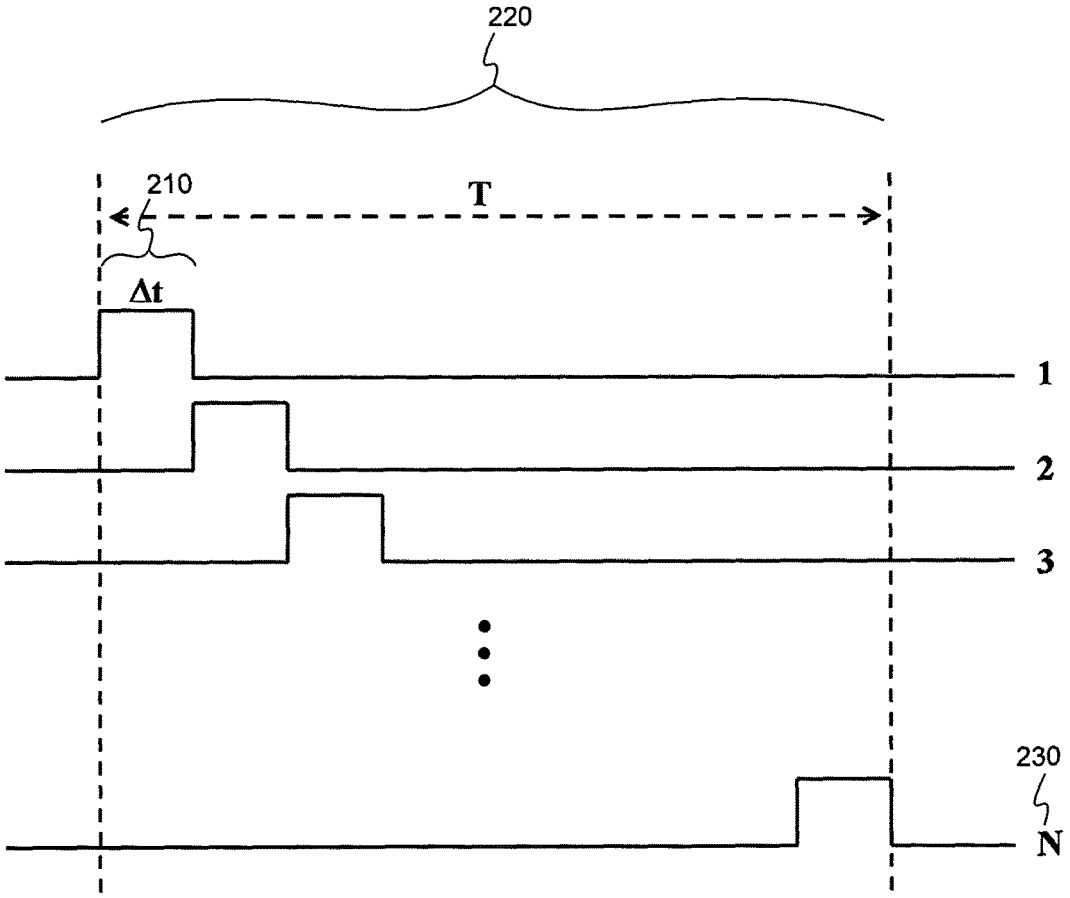
FIG. 2 is an exemplary timing diagram showing how a series of measurements are conventionally made over a total time, such as a liquid chromatography (LC) peak width.
Figure 2:
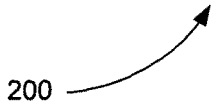

FIG. 2 is an exemplary timing diagram 200 showing how a series of measurements are conventionally made over a total time, such as an LC peak width. The duty cycle of each individual measurement is the measurement time ($\Delta t$) 210 divided by the total time (T) 220. The total time is defined by the period over which the measurement can be made, for example, an LC peak width. The measurement time is determined by the number of measurements (N) 230 that need to be done during the total time, i.e. $\Delta t = T/N$. To improve upon the signal-to-noise ratio, the length of the measurement time $\Delta t$ 210 is typically extended. However, when using serial measurements this means fewer measurements can be made.

In various embodiments, methods and systems are provided for multiplexed precursor ion isolation in order to eliminate the tradeoff between the overall duty cycle of the data collection process and the S/N of the quantitative data that is collected. Specifically, methods and systems provide flow through multiplexing that can be implemented on a triple quadrupole (QQQ), a quadrupole time-of-flight (Q-TOF) mass spectrometer, and/or a hybrid linear ion trap triple quadrupole (such as a QTrap) mass spectrometer operated in an enhanced product ion (EPI) mode, which is a mass spectrum where the ion trap is scanned over a mass range of interest. The sensitivity of the Q-TOF mass spectrometer and the linear ion trap mass spectrometer can be enhanced through the use of multiplexing. A QQQ, Q-TOF or linear ion trap mass spectrometer are described herein for illustration purposes. One skilled in the art can appreciate that other types of instruments can equally benefit from multiplexing.

Essentially, multiplexed precursor ion isolation involves selecting and transmitting two or more target precursor ions in the same time period. Another important aspect of multiplexed precursor ion isolation is continuous operation or flow through multiplexing. In other words, multiplexed precursor ion isolation is performed on a continuous flow of ions through the mass spectrometer. There is no time penalty for selecting or isolating two or more target precursor ions at the same time.

Figure 3:
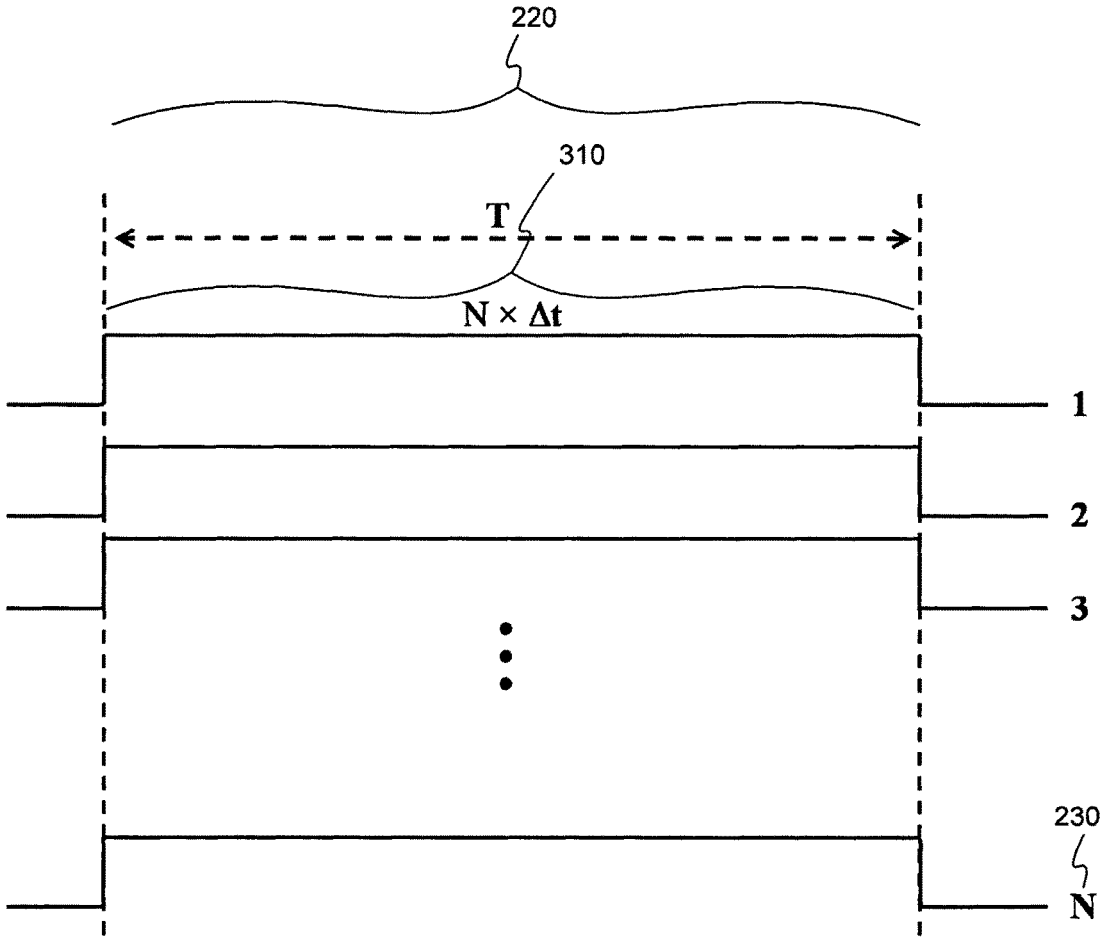
FIG. 3 is an exemplary timing diagram showing how multiplexed precursor ion isolation performs measurements simultaneously, in accordance with various embodiments.
Figure 3:
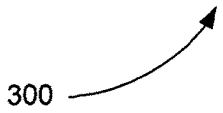

FIG. 3 is an exemplary timing diagram 300 showing how multiplexed precursor ion isolation performs measurements simultaneously, in accordance with various embodiments. If N 230 measurements are made simultaneously during total time T 220, then the total measurement time for each individual measurement becomes $N \times \Delta t$ 310, which means an increase in duty cycle by a factor of N. This also leads to an improved signal-to-noise ratio for each measurement, which leads to lower limits of detection, or a more sensitive mass spectrometer.

Figure 4:
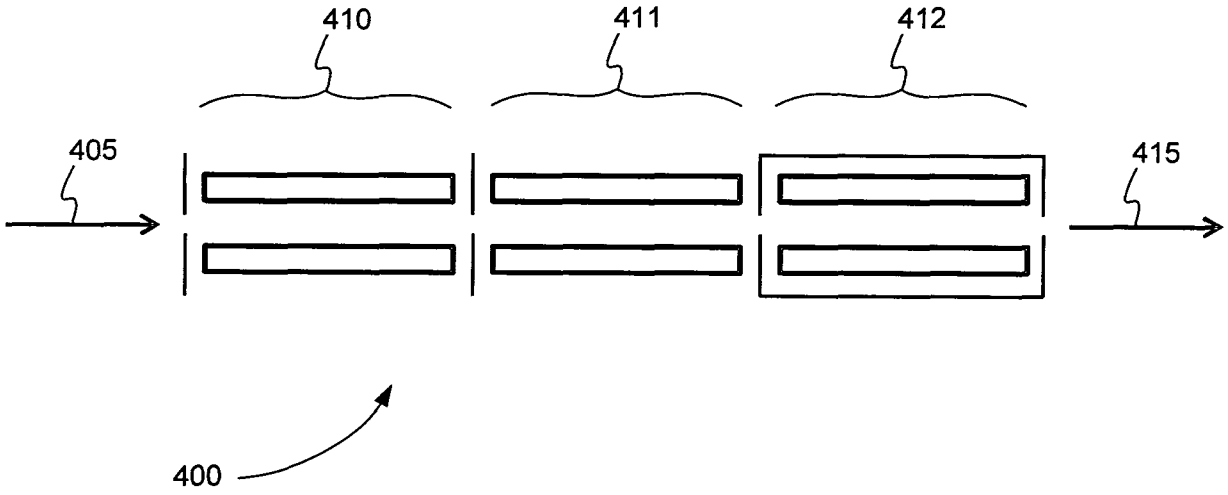
FIG. 4 is an exemplary schematic diagram of a series of quadrupoles that perform precursor ion selection and fragmentation on a beam of ions, in accordance with various embodiments.

FIG. 4 is an exemplary schematic diagram of a series of quadrupoles 400 that perform precursor ion selection and fragmentation on a beam of ions, in accordance with various embodiments. Series of quadrupoles 400 include quadrupole 410, quadrupole 411, and quadrupole 412. A beam of precursor ions 405 is transmitted to quadrupole 410 from an ion source (not shown). Quadrupole 410 is a Q0 quadrupole, quadrupole 411 is a Q1 quadrupole, and quadrupole 412 is a Q2 quadrupole, for example.

Quadrupole 410 is an ion guide and quadrupole 411 is a mass filter, for example. Quadrupole 410 and quadrupole 411 can both be ion guides. However, a typical ion guide does not have the ability to apply resolving DC to the quadrupole, whereas a mass filter does. A filtered noise field (FNF) waveform can be applied in either of these quadrupoles. Applying an FNF waveform to a quadrupole with resolving DC applied means, for example, that the frequency components of the waveform are calculated taking into account the resolving DC potential.

Precursor ion selection takes place in both quadrupole 410 and quadrupole 411. A quadrupole 411 is operating at a pressure of $<10^{-4}$ Torr, for example. Quadrupoles 410 and 412 can operate from a few mTorr to 10 mTorr. Quadrupole 412 is a fragmentation device or collision cell, for example. One skilled in the art can appreciate that any type of fragmentation device can be used. Product ions 415 of the selected precursor ions are transmitted from quadrupole 412 for mass analysis, for example.

In various embodiments, multiplexed precursor ion isolation is performed using an FNF waveform. Dipolar excitation is used to excite the ions. The FNF waveform is applied using dipolar excitation, which is shown by the arrows in FIGS. 7 and 8. For example, multiple precursor ions are selected at the same time in quadrupole 410 by applying an FNF field in quadrupole 410.

Figure 5:
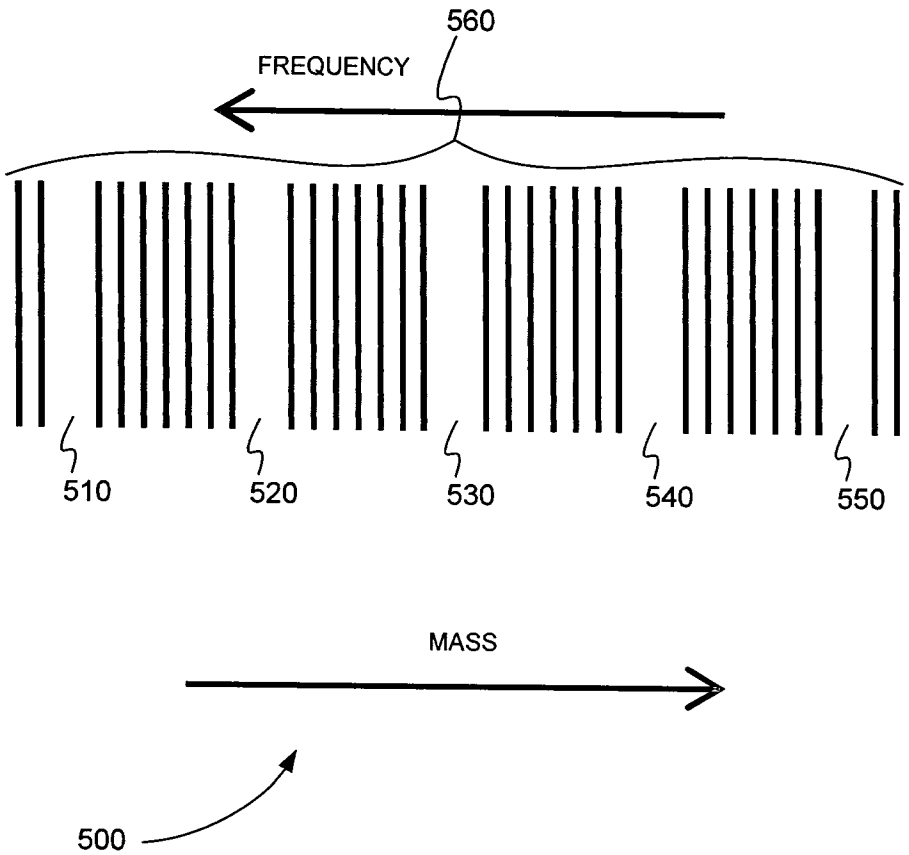
FIG. 5 is an exemplary comb of frequencies used to create a filtered noise field (FNF) waveform, in accordance with various embodiments.

FIG. 5 is an exemplary comb of frequencies 500 used to create an FNF waveform, in accordance with various embodiments. Each vertical line represents a frequency component. The notches are frequency components that have been removed. The missing frequency components correspond to the secular frequencies of the precursor ions that are intended to be selected. An FNF waveform is created from a comb of frequencies spanning a range of frequencies determined by the masses of interest. Precursor ion masses 510-550 are selected by applying comb of frequencies 560.

Figure 6:
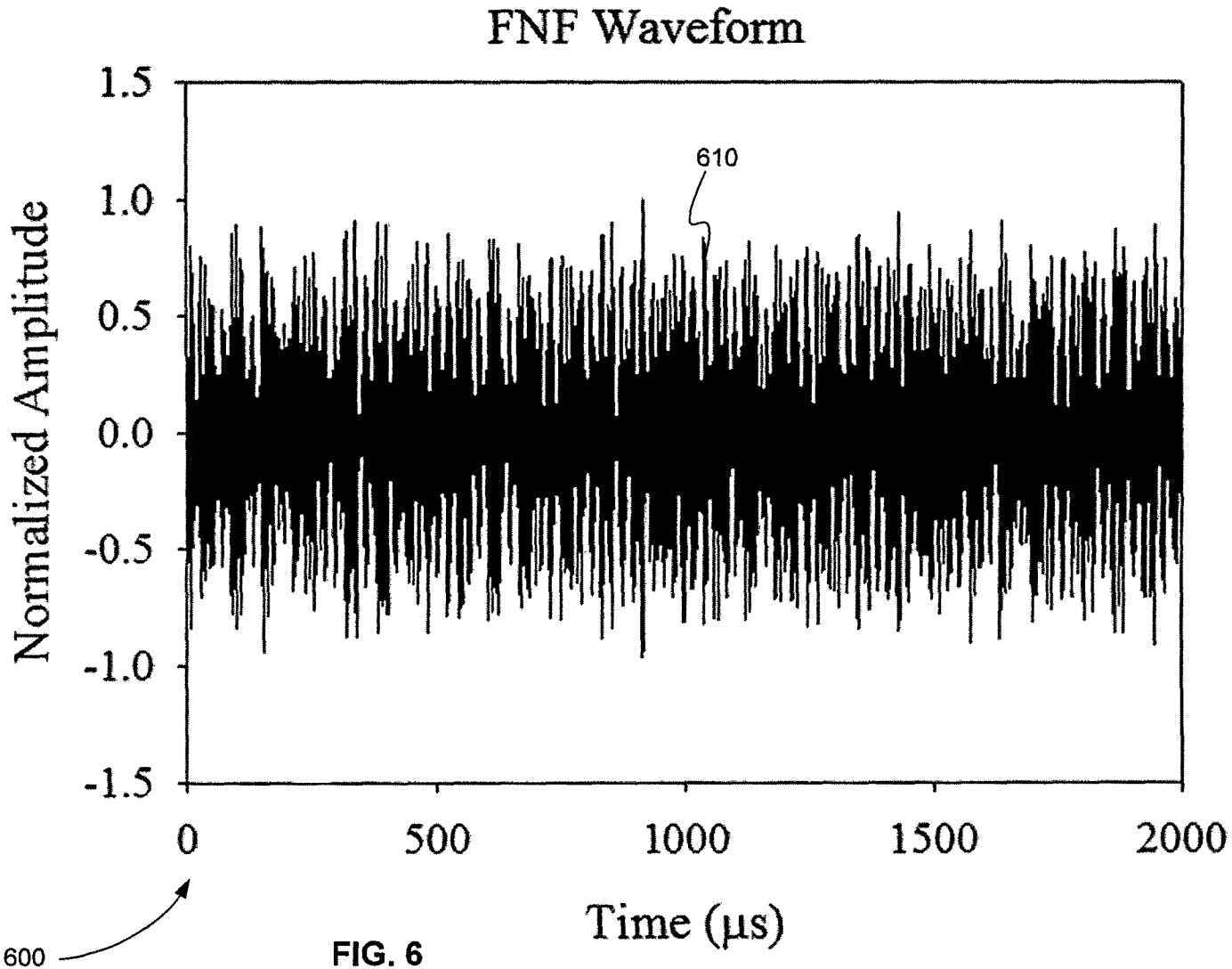
FIG. 6 is a plot of an exemplary FNF waveform that consists of six bands of frequencies (five notches) covering the range 225 kHz to 375 kHz, in accordance with various embodiments.

FIG. 6 is a plot 600 of an exemplary FNF waveform 610 that consists of six bands of frequencies (five notches) covering the range 225 kHz to 375 kHz, in accordance with various embodiments. The individual frequency components of FNF waveform 610 are spaced 0.5 kHz. The notches are <5 kHz wide. The number of individual waveform components (frequencies) is 256. There are 20,000 points in FNF waveform 610. FNF waveform 610 is 2 μs in duration, so what is shown in FIG. 6 repeats continuously. There is nothing in the appearance of FNF waveform 610 that indicates the absence of individual waveform components. FNF waveforms look very similar with or without the notches. The six bands of frequencies in FNF waveform 610 are shown in the table below.

| Start Freq (kHz) | Stop Freq (kHz) |
|---|---|
| 355 | 375 |
| 330 | 350 |
| 300 | 325 |
| 275 | 295 |
| 250 | 270 |
| 225 | 245 |

The choice of frequencies is dependent upon the Mathieu q value for each ion that is inversely proportional to the mass of the ion when the quadrupole is held at a fixed radio frequency (RF) amplitude, for example. The value q is defined by equation (1):

$$q = \frac{4eV_{rf}}{mr_0^2\Omega^2}. \tag{1}$$

where e is the electronic charge, $V_{rf}$ is the RF amplitude measured pole to ground, m is the mass of the ion, $r_0$ is the field radius of the quadrupole, and Ω is the angular drive frequency of the quadrupole. As can be seen from equation (1), each ion has its own particular q value when the RF amplitude is held constant. An ion's frequency of motion, ω0 , can be determined from equation (2)

$$\omega_0 = \beta\frac{\Omega}{2} \tag{2}$$

where β is a function of q. Ions that are not to be removed will have their respective frequencies absent from the FNF waveform. The missing frequencies create holes in mass space located, for example, at the positions 510-550 in FIG. 5.

In various embodiments, the FNF waveform is applied between a pair of quadrupole rods. In various alternative embodiments, the FNF waveform is applied between a pair of auxiliary electrodes in a quadrupole.

Figure 7:
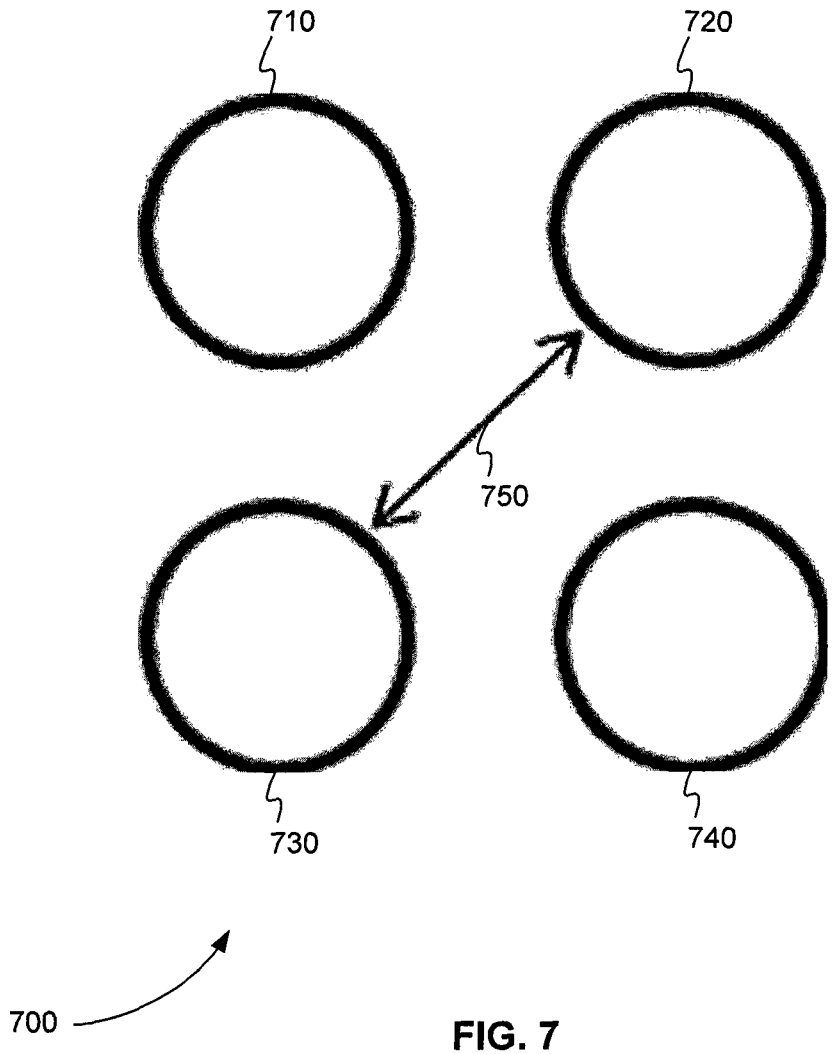
FIG. 7 is a cross sectional diagram of quadrupole rods showing how an FNF waveform is applied between a pair of quadrupole rods, in accordance with various embodiments.

FIG. 7 is a cross sectional diagram of quadrupole rods 700 showing how an FNF waveform is applied between a pair of quadrupole rods, in accordance with various embodiments. FNF waveform 750 is applied between quadrupole rod 720 and quadrupole rod 730, for example. An FNF waveform can also be applied between quadrupole rod 710 and quadrupole rod 740, for example. By applying an FNF waveform to the rods of a quadrupole, the modification to the quadrupole is minimal with no need for additional electrodes to be added to the quadrupole.

Figure 8:
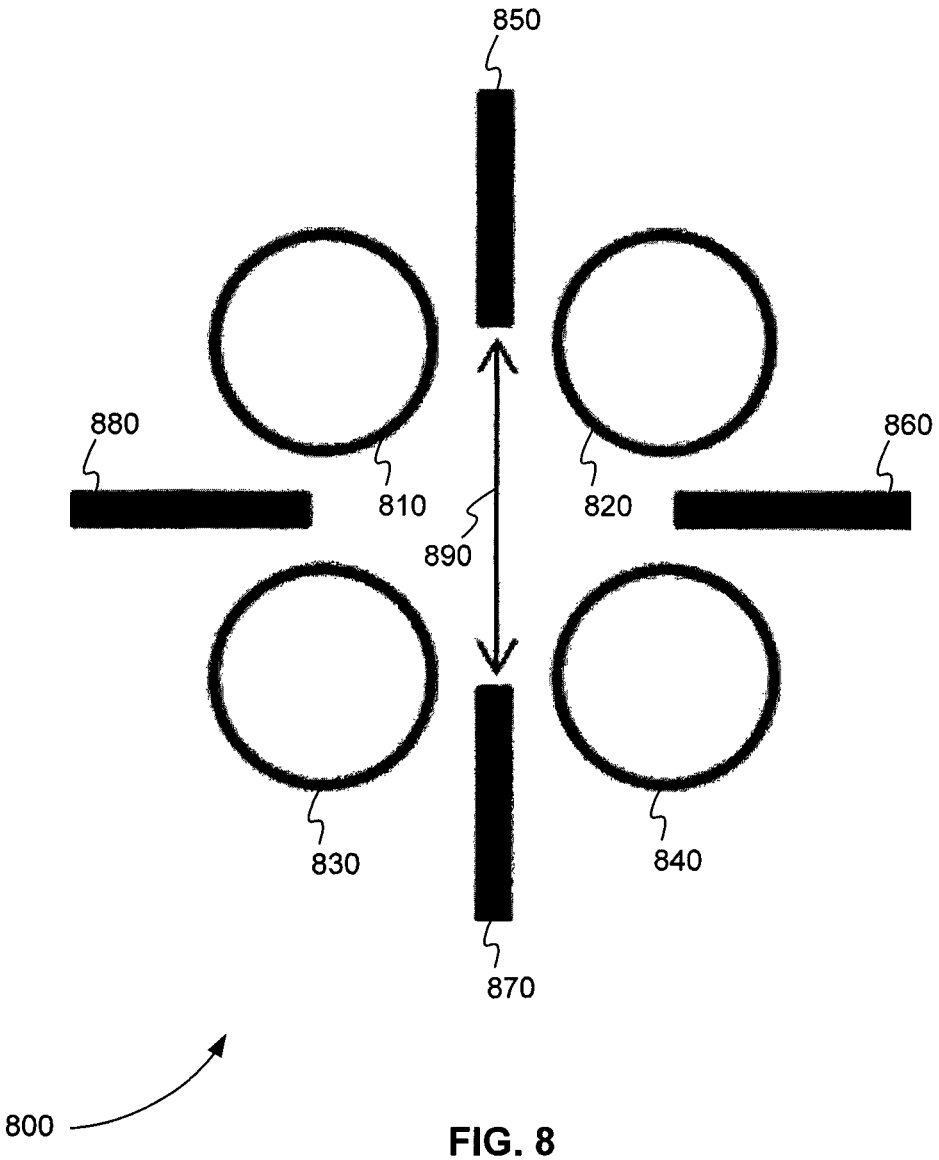
FIG. 8 is a cross sectional diagram of quadrupole rods showing how an FNF waveform is applied between a pair of auxiliary electrodes placed between quadrupole rods, in accordance with various embodiments.

FIG. 8 is a cross sectional diagram of quadrupole rods 800 showing how an FNF waveform is applied between a pair of auxiliary electrodes placed between quadrupole rods, in accordance with various embodiments. Auxiliary electrodes 850-880 are placed between the quadrupole rods 810-840. FNF waveform 890 is applied between auxiliary electrode 850 and auxiliary electrode 870. An FNF waveform can also be applied between auxiliary electrode 860 and auxiliary electrode 880.

Returning to FIG. 4, the pressure in quadrupole 410 is typically between 3 to 10 mTorr of nitrogen. At this pressure ions need several milliseconds to pass through the quadrupole. This amount of time is sufficient for the FNF waveform to effectively remove unwanted ions.

In various embodiments, ions are removed by excitation of the ion until its radial amplitude reaches a point where the ion collides with an electrode. Alternatively, ions are removed by internal excitation of the ions through collisions with a background gas causing the ions to dissociate with their fragment ions located in another region of mass space. It is likely that both mechanisms for the removal of ions are occurring at the same time. The fraction of each will depend upon the amplitude of the FNF waveform. Higher amplitude leads to more ions hitting the rods while lowering the excitation amplitude leads to more fragmentation of the ion under excitation. When internal excitation occurs, a fragment ion may be itself excited by a component of the FNF waveform or be removed in the next step in quadrupole 411, if it is in a region of mass space unaffected by the FNF. The FNF waveform needs to only encompass a mass range spanning from the low mass side of the lowest mass precursor ion to the high mass side of the highest mass precursor ion. This produces a mass spectrum that has ions removed only in the region covered by the FNF.

Figure 9:
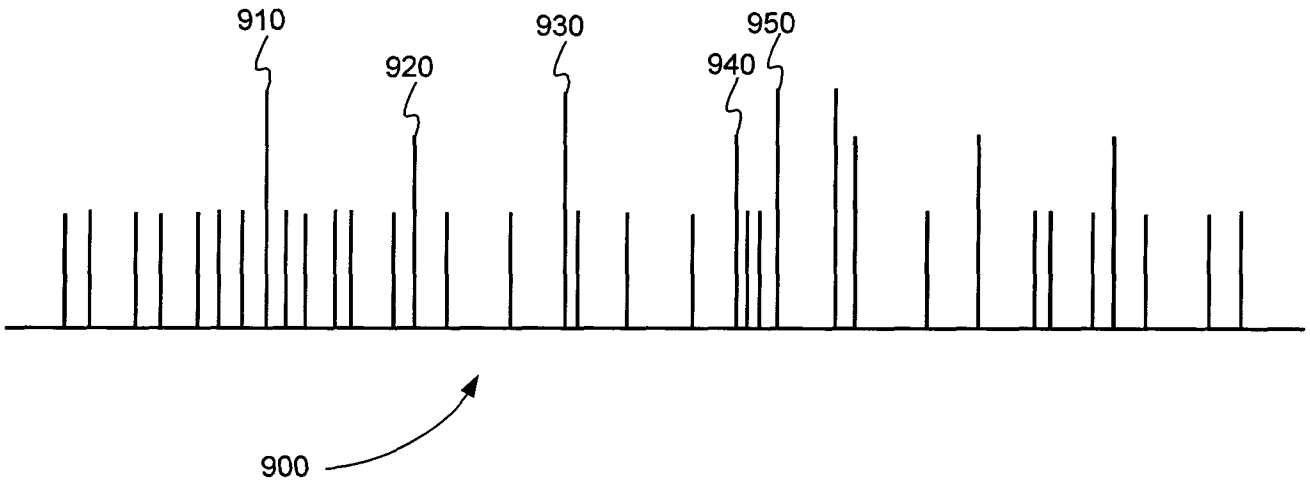
FIG. 9 is a plot of an exemplary mass spectrum of precursor ions before multiplex precursor ion isolation, in accordance with various embodiments.

FIG. 9 is a plot 900 of an exemplary mass spectrum of precursor ions before multiplex precursor ion isolation, in accordance with various embodiments. Peaks 910-950 represent, for example, five target precursor ions. Plot 900 shows the mass spectrum as the ions enter a first quadrupole, such as quadrupole 410 of FIG. 4.

Figure 10:
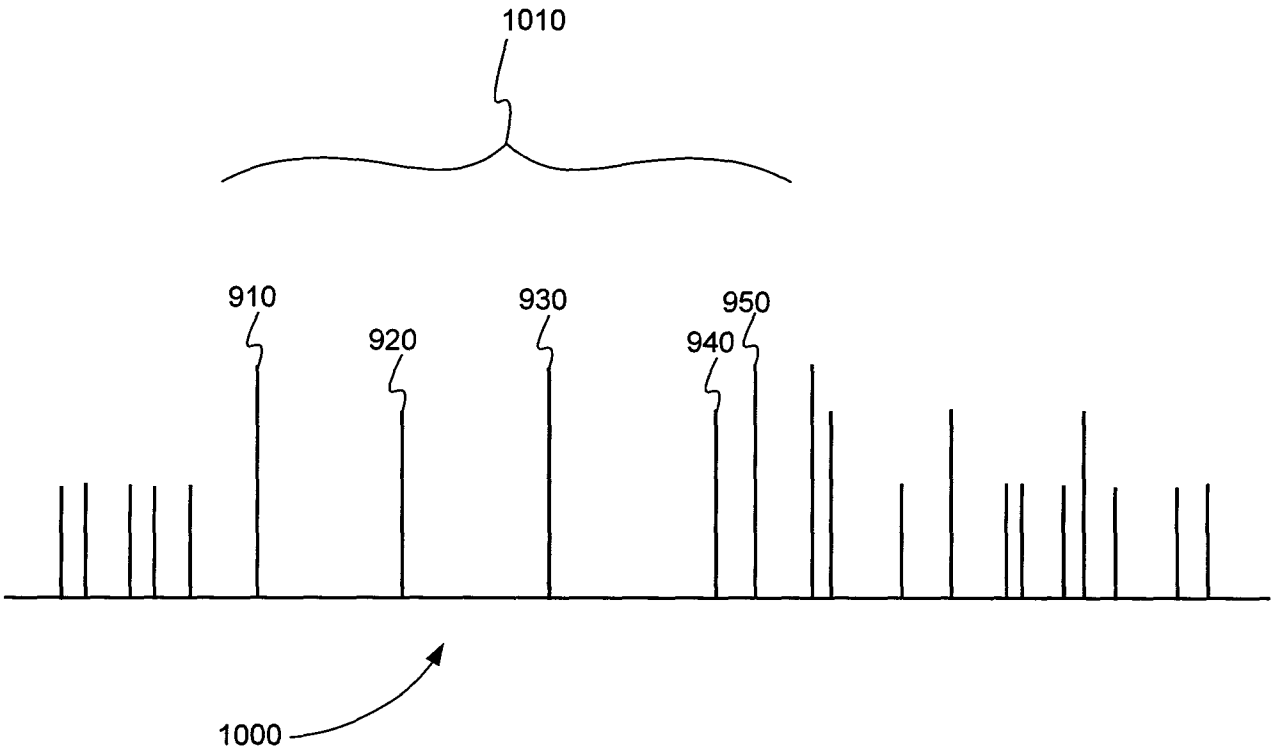
FIG. 10 is a plot of an exemplary mass spectrum of precursor ions after multiplex precursor ion isolation using an FNF waveform, in accordance with various embodiments.
Figure 11:
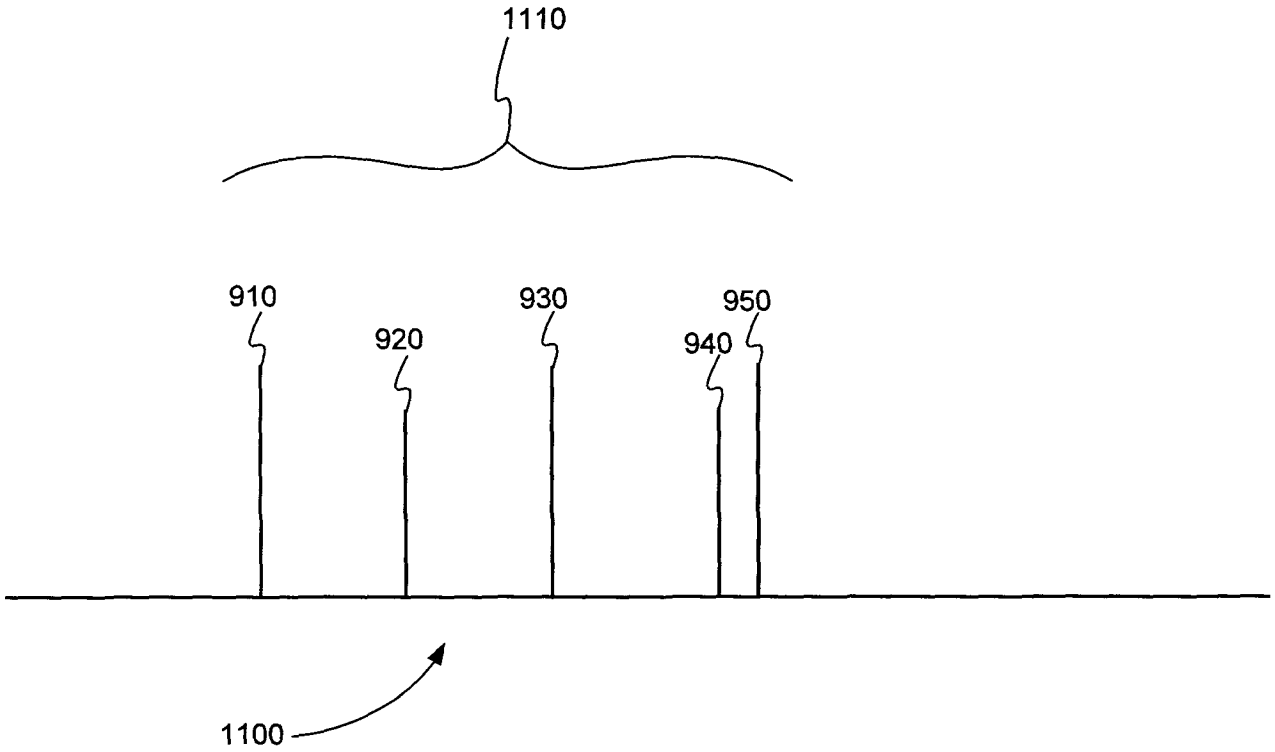
FIG. 11 is a plot of an exemplary mass spectrum of precursor ions after radio frequency (RF) and direct current (DC) potentials were used to resolve a mass range over which an FNF waveform was applied, in accordance with various embodiments.

FIG. 10 is a plot 1000 of an exemplary mass spectrum of precursor ions after multiplex precursor ion isolation using an FNF waveform, in accordance with various embodiments. An FNF waveform is applied to region 1010 isolating peaks 910-950 of the five target precursor ions. Plot 1000 shows the mass spectrum after the ions have passed through the first quadrupole, such as quadrupole 410 of FIG. 4, and have experienced the FNF waveform.

In various embodiments, ions outside of region 1010 are removed by applying a resolving direct current (DC) potential to a mass analyzing quadrupole, such as quadrupole 411 of FIG. 4. In various embodiments, the amount of resolving DC potential that is applied is calculated based upon the desired mass range to be transmitted through the mass analyzing quadrupole.

In various embodiments, the mass window covered by the FNF waveform and the mass window in quadrupole 411 are ideally matched. In various alternative embodiments, the windows are mis-matched with the FNF waveform mass range covering the same or more than the mass window in quadrupole 411. Note that the wider the FNF waveform range, then the more waveform components (or frequencies) required, which means more power is required to generate the FNF waveform. It is generally better to have fewer waveform components than more. This lessens the demands for amplitude on the power supply for the FNF waveform. For example, if the frequency components happen to be in phase at some point in time, then the power supply must deliver an amplitude equal to the sum of the amplitudes of the individual frequency components.

Figure 12:
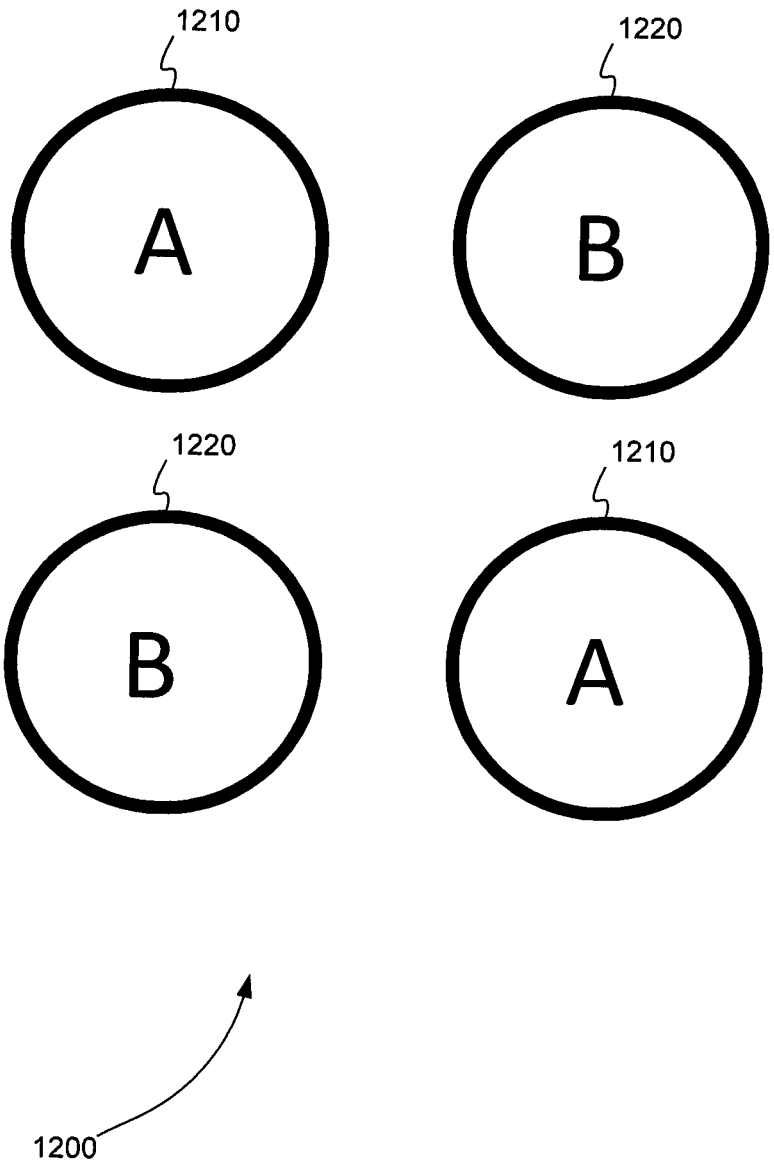
FIG. 12 a cross-sectional view of quadrupole rods labeled to show A and B poles, in accordance with various embodiments.

FIG. 12 a cross-sectional view 1200 of quadrupole rods labeled to show A 1210 and B 1220 poles, in accordance with various embodiments. The location and width of the mass window are determined by the amplitude of the RF potential and the magnitude of the resolving DC applied to the mass analyzing quadrupole, such as quadrupole 411 of FIG. 4. The RF potential runs with a 180° phase difference between the A 1210 and B 1220 poles.

Figure 13:
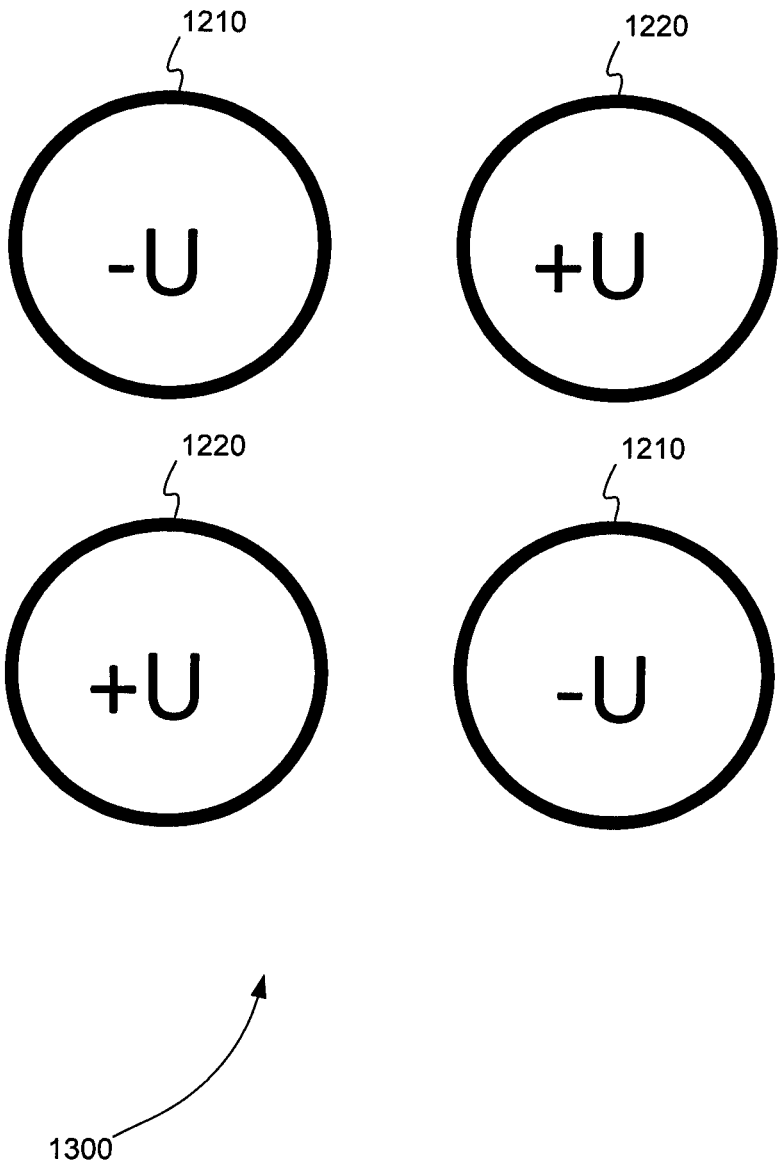
FIG. 13 a cross-sectional view of quadrupole rods labeled to show resolving DC (U) polarities applied to poles A and B of FIG. 12, in accordance with various embodiments.

FIG. 13 a cross-sectional view 1300 of quadrupole rods labeled to show resolving DC (U) polarities applied to poles A 1210 and B 1220 of FIG. 12, in accordance with various embodiments. U is applied in opposite polarities to the 1210 and 1220 poles of the mass resolving quadrupole.

The amplitude of the RF and the magnitude of the resolving DC can be adjusted to allow for the transmission of a desired mass range through the mass analyzing quadrupole. The amplitude of the RF and the magnitude of the resolving DC can be found from the Mathieu parameters $$a = \frac{8eU}{mr_0^2\Omega^2}$$

and $$q = \frac{4eV}{mr_0^2\Omega^2}$$

where m is the mass, ro is the field radius of the quadrupole, ω is the angular drive frequency of the quadrupole, U is the resolving DC measured pole to ground and V is the RF amplitude measured pole to ground.

The variables U and V are the only parameters required to set up the quadrupole to allow transmission of a large mass window. The parameters a and q are the Mathieu parameters which can be used to determine if an ions' passage through a quadrupole mass analyzer is stable or unstable.

Figure 14:
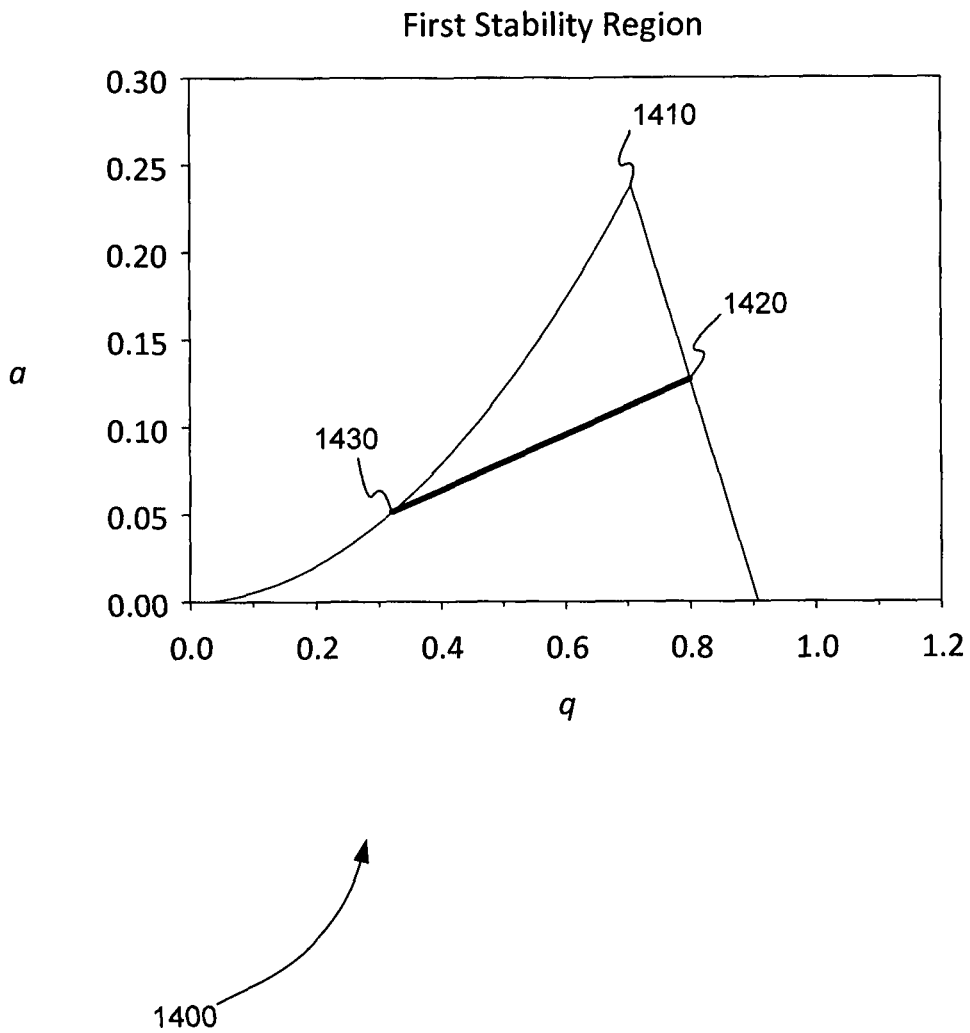
FIG. 14 is an exemplary Mathieu stability diagram, which applies to the typical operation of a mass analyzer, in accordance with various embodiments.

FIG. 14 is an exemplary Mathieu stability diagram 1440, which applies to the typical operation of a mass analyzer, in accordance with various embodiments. Ions that have values for a and q, which are inside the triangular region 1410 are stable and are transmitted through the quadrupole. Those outside region 1410 are lost. The intersection of the thicker line with the boundaries of the stability diagram define the a and q values for those ions within the large mass window. The intersection 1420 at high q represents the a, q value for the ions at the low mass edge of the large mass window while the intersection 1430 at low q represents the a, q value for the ions at the high mass edge of the large mass window. A single U, V combination will satisfy the requirements for a and q at both intersections and can be calculated through an iterative process.

Filtered Noise Field System

Figure 15:
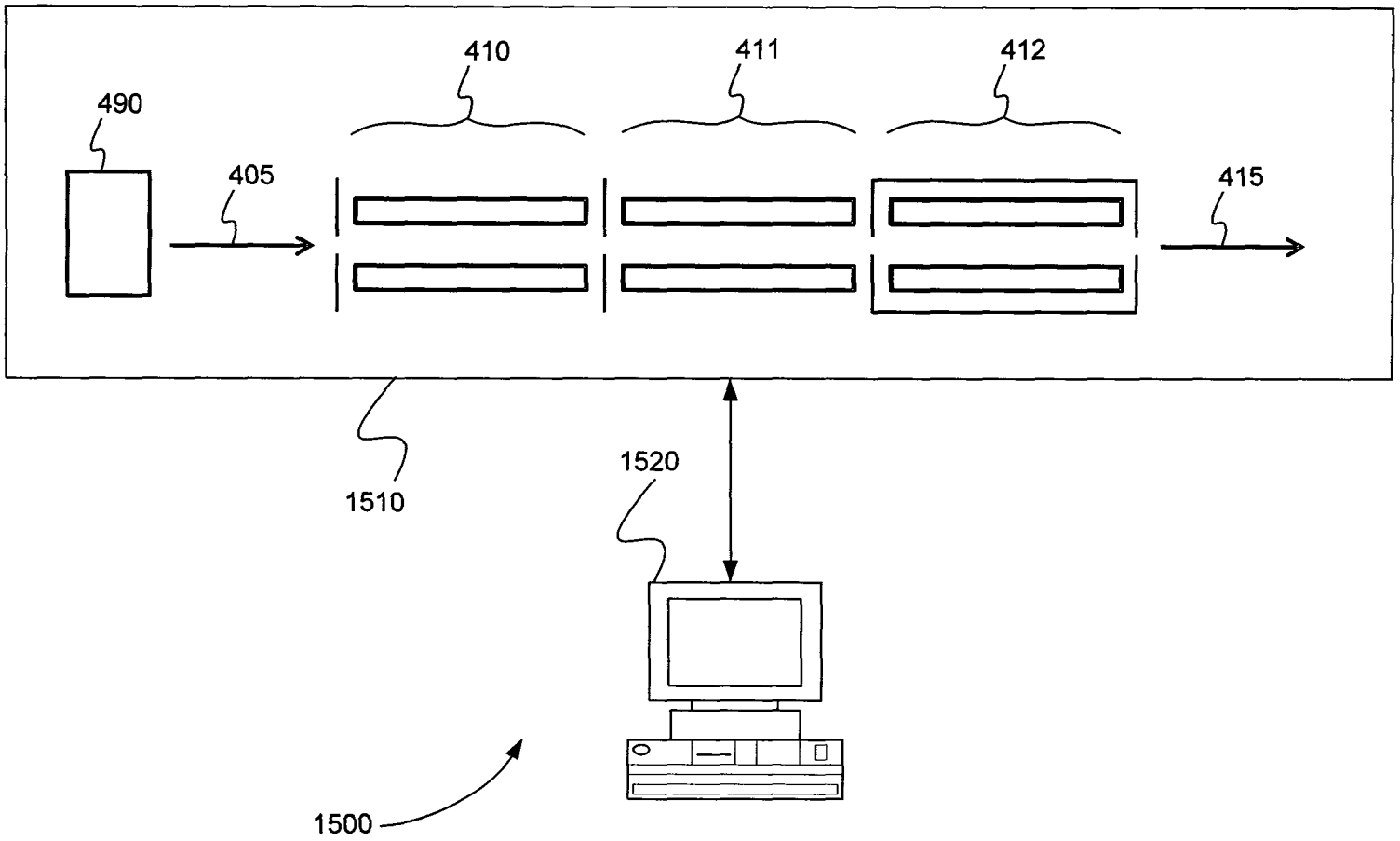
FIG. 15 is a schematic diagram of a system for multiplexed precursor ion selection using a FNF, in accordance with various embodiments.

FIG. 15 is a schematic diagram of a system 1500 for multiplexed precursor ion selection using a FNF, in accordance with various embodiments. System 1500 includes mass spectrometer 1510 and processor 1520.

Mass spectrometer 1510 includes ion source 490, first quadrupole 410, second quadrupole 411, and third quadrupole 412. Ion source 490 provides a continuous beam of ions to quadrupole 410. First quadrupole 410 receives the continuous beam of ions from ion source 490. First quadrupole 410 and is adapted to apply an FNF waveform to the continuous beam of ions.

Processor 1520 can be, but is not limited to, a computer, microprocessor, or any device capable of sending and receiving control signals and data to and from mass spectrometer 1510. Processor 1520 is in communication with mass spectrometer 1510.

Processor 1520 selects two or more different precursor ions. Processor 1520 does this by calculating an FNF waveform. In various embodiments, frequencies are removed from the calculated FNF waveform that corresponds to masses of the two or more different precursor ions.

Processor 1520 applies the calculated FNF waveform to the continuous beam of ions. Processor 1520 does this by sending information to mass spectrometer 1510 so that the first quadrupole applies the calculated FNF waveform to the continuous beam of ions. One of ordinary skill in the art can appreciate that information can include control information, data information, or both.

Processor 1520 calculates an FNF waveform. Processor 1520 selects two or more different precursor ions by removing frequencies from the calculated FNF waveform that correspond to masses of the two or more different precursor ions. Processor 1520 sends control information to mass spectrometer 1510 so that first quadrupole 410 applies the calculated FNF waveform to the continuous beam of ions.

In various embodiments, first quadrupole 410 applies the FNF waveform to the beam of ions by applying the calculated FNF waveform between pairs of rods.

In various embodiments, first quadrupole 410 further includes auxiliary electrodes placed between its rods. First quadrupole 410 applies the calculated FNF waveform to the continuous beam of ions by applying the calculated FNF waveform between pairs of the auxiliary electrodes.

In various embodiments, second quadrupole 411 receives ions transmitted from first quadrupole 410. Second quadrupole 411 is adapted to apply an RF potential and a resolving DC potential to the received ions. Processor 1520 further calculates an RF potential and a DC potential to apply to the received ions in order to remove precursor ions outside of a mass range that includes the two or more different precursor ions. Processor 1520 sends additional control information to the mass spectrometer so that second quadrupole 411 applies the calculated RF potential and a DC potential to the received ions.

In various embodiments, first quadrupole 410 and the second quadrupole 411 are electrically decoupled. For example, each quadrupole is supplied by its own electrical power supply.

In various embodiments, the two or more different precursor ions are transmitted from second quadrupole 411 to third quadrupole 412 for fragmentation. Product ions 415 of the selected two or more different precursor ions are transmitted from third quadrupole 412 for mass analysis, for example.

Filtered Noise Field Method

Figure 16:
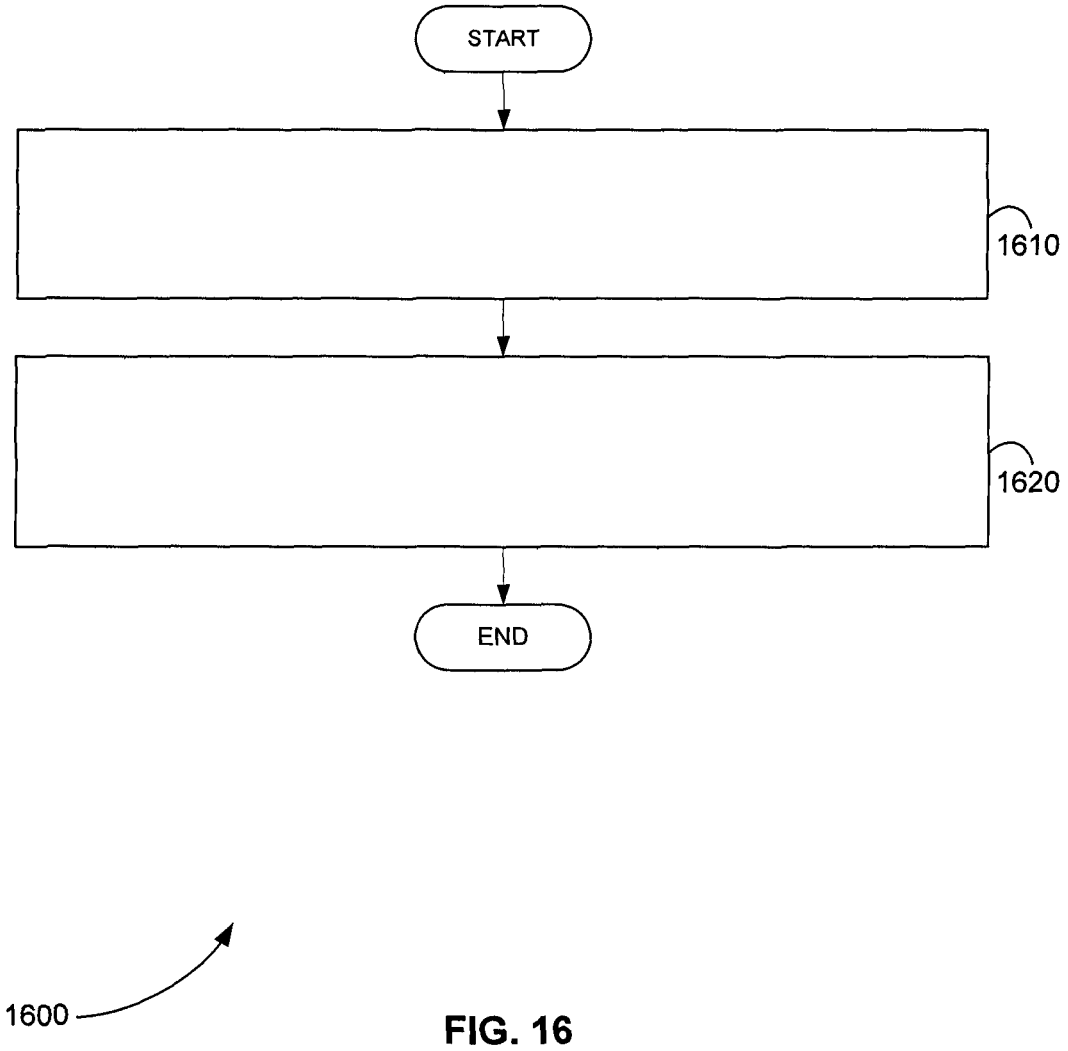
FIG. 16 is a flowchart showing a method for multiplexed precursor ion selection using an FNF, in accordance with various embodiments.

FIG. 16 is a flowchart showing a method 1600 for multiplexed precursor ion selection using an FNF, in accordance with various embodiments.

In step 1610 of method 1600, two or more different precursor ions are selected using a processor. The processor calculates an FNF waveform and removes frequencies from the calculated FNF waveform that correspond to masses of the two or more different precursor ions.

In step 1620, the calculated FNF waveform is applied to a continuous beam of ions using the processor. The processor sends information to a mass spectrometer. The mass spectrometer includes an ion source that provides the continuous beam of ions and a first quadrupole that receives the continuous beam of ions. The information is sent to the mass spectrometer so that the first quadrupole applies the calculated FNF waveform to the continuous beam of ions.

Filtered Noise Field Computer Program Product

Figure 17:
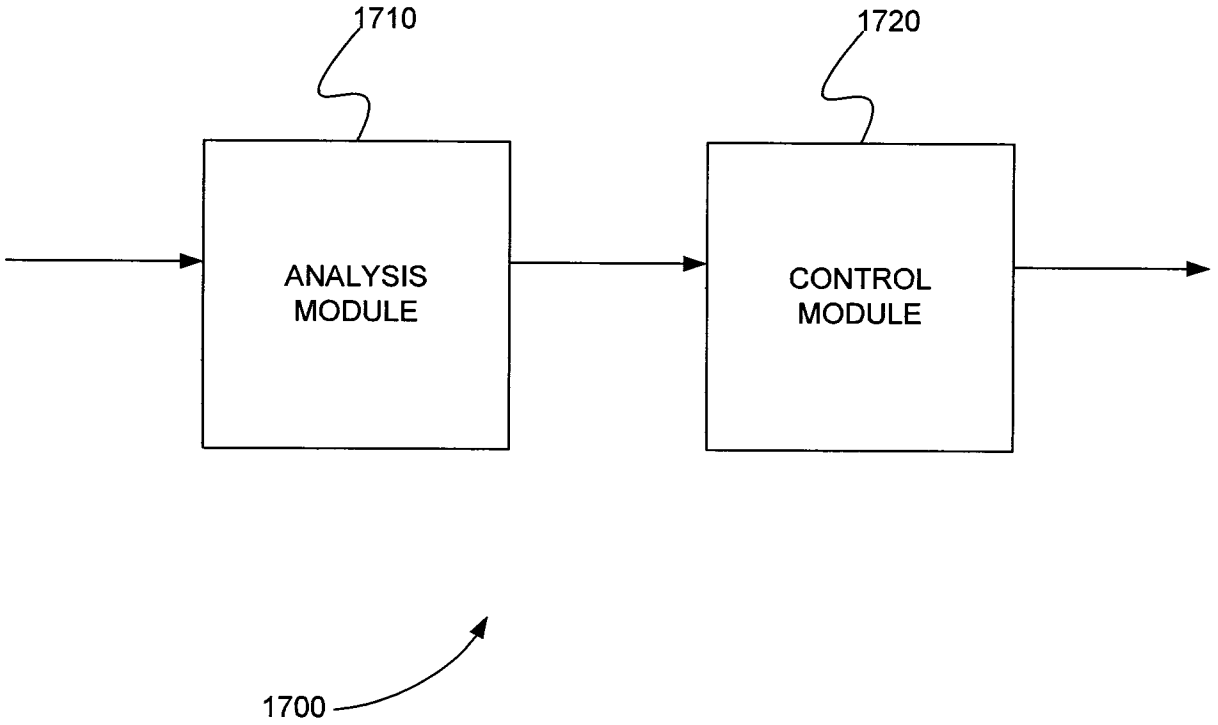
FIG. 17 is a schematic diagram of a system that includes one or more distinct software modules that performs a method for multiplexed precursor ion selection using an FNF, in accordance with various embodiments.

In various embodiments, computer program products include a tangible computer-readable storage medium whose contents include a program with instructions being executed on a processor so as to perform a method for multiplexed precursor ion selection and transmission using an FNF. This method is performed by a system that includes one or more distinct software modules FIG. 17 is a schematic diagram of a system 1700 that includes one or more distinct software modules that performs a method for multiplexed precursor ion selection using an FNF, in accordance with various embodiments. System 1700 includes analysis module 1710 and control module 1720.

Analysis module 1710 selects two or more different precursor ions. Analysis module 1710 does this by calculating an FNF waveform and removing frequencies from the calculated FNF waveform that correspond to masses of the two or more different precursor ions.

Control module 1720 applies the calculated FNF waveform to a continuous beam of ions. Control module 1720 does this by sending information to a mass spectrometer. The mass spectrometer includes an ion source that provides the continuous beam of ions and a first quadrupole that receives the continuous beam of ions. The information is sent to the mass spectrometer so that the first quadrupole applies the calculated FNF waveform to the continuous beam of ions.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A system for multiplexed precursor ion selection using a filtered noise field (FNF), comprising:

a mass spectrometer that includes an ion source that provides a continuous beam of ions, a first quadrupole Q0 that receives the continuous beam of ions and is adapted to apply an FNF waveform to rods or electrodes in the first quadrupole Q0 to excite a mass range of the continuous beam of ions with a comb of frequency components and notches to select two or more different precursor ions within the mass range and transmit the two or more different precursor ions and the precursor ions outside of the mass range, wherein the frequency components remove corresponding precursor ions from the continuous beam of ions and the notches prevent the removal of the two or more different precursor ions within the mass range, and a second quadrupole Q1 that receives the two or more different precursor ions and the precursor ions outside of the mass range transmitted from the first quadrupole Q0 and is adapted to apply a radio frequency (RF) potential and a resolving direct current (DC) potential to excite the received ions to remove the precursor ions outside of the mass range; and a processor in communication with the mass spectrometer that selects the two or more different precursor ions from the continuous beam of ions in the first quadrupole Q0 by calculating an FNF waveform that includes notches for frequency components corresponding to the two or more different precursor ions, applies the calculated FNF waveform to the rods or electrodes in the first quadrupole Q0 by sending information to the mass spectrometer so that the first quadrupole Q0 applies the calculated FNF waveform to the rods or electrodes in the first quadrupole Q0 to excite the continuous beam of ions while passing through the first quadrupole Q0 and transmit the two or more different precursor ions and the precursor ions outside of the mass range to the second quadrupole Q1, wherein the two or more different precursor ions and the precursor ions outside of the mass range are selected and transmitted at the same time by applying the calculated FNF waveform to the rods or electrodes in the first quadrupole Q0, calculates an RF potential and a DC potential to be applied to excite the received ions in order to remove the precursor ions outside of the mass range that includes the two or more different precursor ions, and sends additional control information to the mass spectrometer so that the second quadrupole Q1 applies the calculated RF potential and DC potential to excite the received ions and remove the precursor ions outside of the mass range.

2. The system of claim 1, wherein the first quadrupole Q0 applies the calculated FNF waveform by applying the calculated FNF waveform between pairs of rods in the first quadrupole Q0.

3. The system of claim 1, wherein the first quadrupole Q0 further includes auxiliary electrodes placed between rods of the first quadrupole Q0.

4. The system of claim 3, wherein the first quadrupole Q0 applies the calculated FNF waveform by applying the calculated FNF waveform between pairs of the auxiliary electrodes.

5. The system of claim 1, wherein the first quadrupole Q0 and the second quadrupole Q1 are decoupled.

6. A method for multiplexed precursor ion selection using a filtered noise field (FNF), comprising:

selecting two or more different precursor ions from a continuous beam of ions in a first quadrupole Q0 using a processor by calculating an FNF waveform that includes notches for frequency components corresponding to the two or more different precursor ions;

applying the calculated FNF waveform to rods or electrodes in the first quadrupole Q0 using the processor by sending information to a mass spectrometer, which includes an ion source that provides the continuous beam of ions, the first quadrupole Q0 that receives the continuous beam of ions, so that the first quadrupole Q0 applies the calculated FNF waveform to rods or electrodes in the first quadrupole Q0 to excite a mass range of the continuous beam of ions with a comb of frequency components and notches to select the two or more different precursor ions within the mass range and transmit the two or more different precursor ions and the precursor ions outside of the mass range, wherein the frequency components remove corresponding precursor ions from the continuous beam of ions and the notches prevent the removal of the two or more different precursor ions within the mass range and wherein the two or more different precursor ions and the precursor ions outside of the mass range are selected and transmitted at the same time by applying the calculated FNF waveform to the rods or electrodes in the first quadrupole Q0, and a second quadrupole Q1 that receives the two or more different precursor ions and the precursor ions outside of the mass range transmitted from the first quadrupole Q0 and is adapted to apply a radio frequency (RF) potential and a resolving direct current (DC) potential to excite the received ions to remove the precursor ions outside of the mass range;

calculating an RF potential and a DC potential to be applied to excite the received ions in order to remove the precursor ions outside of the mass range that includes the two or more different precursor ions; and sending additional control information to the mass spectrometer so that the second quadrupole Q1 applies the calculated RF potential and DC potential to excite the received ions and remove the precursor ions outside of the mass range.

7. The method of claim 6, wherein the first quadrupole Q0 applies the calculated FNF waveform by applying the calculated FNF waveform between pairs of rods in the first quadrupole Q0.

8. The method of claim 6, wherein the first quadrupole Q0 further includes auxiliary electrodes placed between rods of the first quadrupole Q0.

9. The method of claim 8, wherein the first quadrupole Q0 applies the calculated FNF waveform by applying the calculated FNF waveform between pairs of the auxiliary electrodes.

10. The method of claim 6, wherein the first quadrupole Q0 and the second quadrupole Q1 are decoupled.

11. A computer program product, comprising a non-transitory and tangible computer-readable storage medium whose contents include a program with instructions being executed on a processor so as to perform a method for multiplexed precursor ion selection using a filtered noise field (FNF), comprising:

providing a system, wherein the system comprises one or more distinct software modules, and wherein the distinct software modules comprise an analysis module and a control module;

selecting two or more different precursor ions from a continuous beam of ions in a first quadrupole Q0 using the analysis module by calculating an FNF waveform that includes notches for frequency components corresponding to the two or more different precursor ions;

applying the calculated FNF waveform to rods or electrodes in the first quadrupole Q0 using the control module by sending information to a mass spectrometer, which includes an ion source that provides the continuous beam of ions, the first quadrupole Q0 that receives the continuous beam of ions, so that the first quadrupole Q0 applies the calculated FNF waveform to the rods or electrodes in the first quadrupole Q0 to excite a mass range of the continuous beam of ions with a comb of frequency components and notches to select two or more different precursor ions within the mass range and transmit the two or more different precursor ions and the precursor ions outside of the mass range, wherein the frequency components remove corresponding precursor ions from the continuous beam of ions and the notches prevent the removal of the two or more different precursor ions within the mass range and wherein the two or more different precursor ions and the precursor ions outside of the mass range are selected and transmitted at the same time by applying the calculated FNF waveform to the rods or electrodes in the first quadrupole Q0, and a second quadrupole Q1 that receives the two or more different precursor ions and the precursor ions outside of the mass range transmitted from the first quadrupole Q0 and is adapted to apply a radio frequency (RF) potential and a resolving direct current (DC) potential to excite the received ions to remove the precursor ions outside of the mass range;

calculating an RF potential and a DC potential to be applied to excite the received ions in order to remove the precursor ions outside of the mass range that includes the two or more different precursor ions; and sending additional control information to the mass spectrometer so that the second quadrupole Q1 applies the calculated RF potential and DC potential to excite the received ions and remove the precursor ions outside of the mass range.

12. The computer program product of claim 11, wherein the first quadrupole Q0 applies the calculated FNF waveform by applying the calculated FNF waveform between pairs of rods in the first quadrupole Q0.

13. The computer program product of claim 11, wherein the first quadrupole Q0 further includes auxiliary electrodes placed between rods of the first quadrupole Q0.

14. The computer program product of claim 13, wherein the first quadrupole Q0 applies the calculated FNF waveform by applying the calculated FNF waveform between pairs of the auxiliary electrode.

15. The computer program product of claim 11, wherein the first quadrupole Q0 and the second quadrupole Q1 are decoupled.

16. The system of claim 1, wherein the first quadrupole Q0 and the second quadrupole Q1 are supplied by separate power supplies.

17. The method of claim 6, wherein the first quadrupole Q0 and the second quadrupole Q1 are supplied by separate power supplies.

18. The computer program product of claim 11, wherein the first quadrupole Q0 and the second quadrupole Q1 are supplied by separate power supplies.

* * * * *